US009743593B1

(12) United States Patent
Lawson et al.

(10) Patent No.: US 9,743,593 B1
(45) Date of Patent: Aug. 29, 2017

(54) FLOWER ARRANGEMENT SUPPORT

(71) Applicants: Harold Lawson, Hulen, KY (US); Betty Lawson, Hulen, KY (US)

(72) Inventors: Harold Lawson, Hulen, KY (US); Betty Lawson, Hulen, KY (US)

( * ) Notice: Subject to any disclaimer, the term of this patent is extended or adjusted under 35 U.S.C. 154(b) by 177 days.

(21) Appl. No.: 14/810,584

(22) Filed: Jul. 28, 2015

(51) Int. Cl.
*A01G 5/00* (2006.01)
*A01G 5/04* (2006.01)
*E04H 13/00* (2006.01)

(52) U.S. Cl.
CPC ..... *A01G 5/04* (2013.01); *E04H 13/003* (2013.01)

(58) Field of Classification Search
CPC ..... A47G 7/044; A47G 7/02; A47H 27/00; A01G 5/04; A01G 9/02; E04H 13/001
USPC ..... 47/41.01, 41.1, 41.11, 41.13, 41.14, 47/41.15, 41.12, 40, 39, 68; 248/27.8, 248/219.2, 219.3
See application file for complete search history.

(56) References Cited

U.S. PATENT DOCUMENTS 1,765,140 A * 6/1930 Fitl ..... A47G 7/06 416/236 R
3,164,343 A 1/1965 Cucullo
3,302,324 A * 2/1967 MacDonald ..... A47G 7/044 248/27.8
4,217,729 A * 8/1980 Cooper ..... A01G 5/04 47/41.14
4,640,045 A 2/1987 Nesbitt
D299,088 S 12/1988 Monza
5,072,542 A * 12/1991 Quackenbush ..... A01G 9/02 220/23.4
D332,762 S 1/1993 McCafferty, Jr.
5,368,266 A * 11/1994 Allen ..... E04H 13/003 108/47
5,519,966 A * 5/1996 Cassette ..... A01G 5/04 248/512
6,564,506 B1 5/2003 Leger
6,678,975 B1 * 1/2004 Renosky ..... G09F 19/00 40/124.5
6,688,040 B1 * 2/2004 Yang ..... A01G 5/04 47/41.1
7,305,794 B1 12/2007 Cantrell
7,640,694 B1 1/2010 Cantrell
8,523,118 B2 9/2013 Weder
9,307,700 B1 * 4/2016 Schmitt ..... G09F 17/00
9,445,548 B1 * 9/2016 Hicks ..... A01G 5/04
2011/0036001 A1 2/2011 Aker

FOREIGN PATENT DOCUMENTS

GB 191500851 A 10/1957

* cited by examiner

*Primary Examiner* — Trinh Nguyen

(57) ABSTRACT

The flower arrangement support includes a floral saddle that is adapted to be bolted atop of a tombstone via a mounting assembly. The mounting assembly includes a pair of mounting clips that attach onto opposing sides of the floral saddle, and extend downwardly there from. The pair of mounting clips each affix to a threaded rod that is adapted to extend through a drill hole formed in the tombstone. The floral saddle is further defined with a perimeter wall that extends upwardly from a saddle surface. The perimeter wall includes mounting slots on opposing sides that enable the pair of mounting claps to clip there to in order to secure the floral saddle to the tombstone.

3 Claims, 5 Drawing Sheets

FLOWER ARRANGEMENT SUPPORT

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of flower holders and tombstones, more specifically, a flower arrangement support that is adapted to be installed onto a tombstone in order to support a flower arrangement thereon.

SUMMARY OF INVENTION

The flower arrangement support includes a floral saddle that is adapted to be bolted atop of a tombstone via a mounting assembly. The mounting assembly includes a pair of mounting clips that attach onto opposing sides of the floral saddle, and extend downwardly there from. The pair of mounting clips each affix to a threaded rod that is adapted to extend through a drill hole formed in the tombstone. The floral saddle is further defined with a perimeter wall that extends upwardly from a saddle surface. The perimeter wall includes mounting slots on opposing sides that enable the pair of mounting claps to clip there to in order to secure the floral saddle to the tombstone. The flower arrangement support may include multiple drill holes to be formed in the tombstone in order for the floral saddle to attach across a front of the tombstone as opposed to atop of the tombstone.

These together with additional objects, features and advantages of the flower arrangement support will be readily apparent to those of ordinary skill in the art upon reading the following detailed description of the presently preferred, but nonetheless illustrative, embodiments when taken in conjunction with the accompanying drawings.

In this respect, before explaining the current embodiments of the flower arrangement support in detail, it is to be understood that the flower arrangement support is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the flower arrangement support.

It is therefore important that the claims be regarded as including such equivalent construction insofar as they do not depart from the spirit and scope of the flower arrangement support. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

In the drawings.

DETAILED DESCRIPTION OF THE EMBODIMENT

Figure 1:
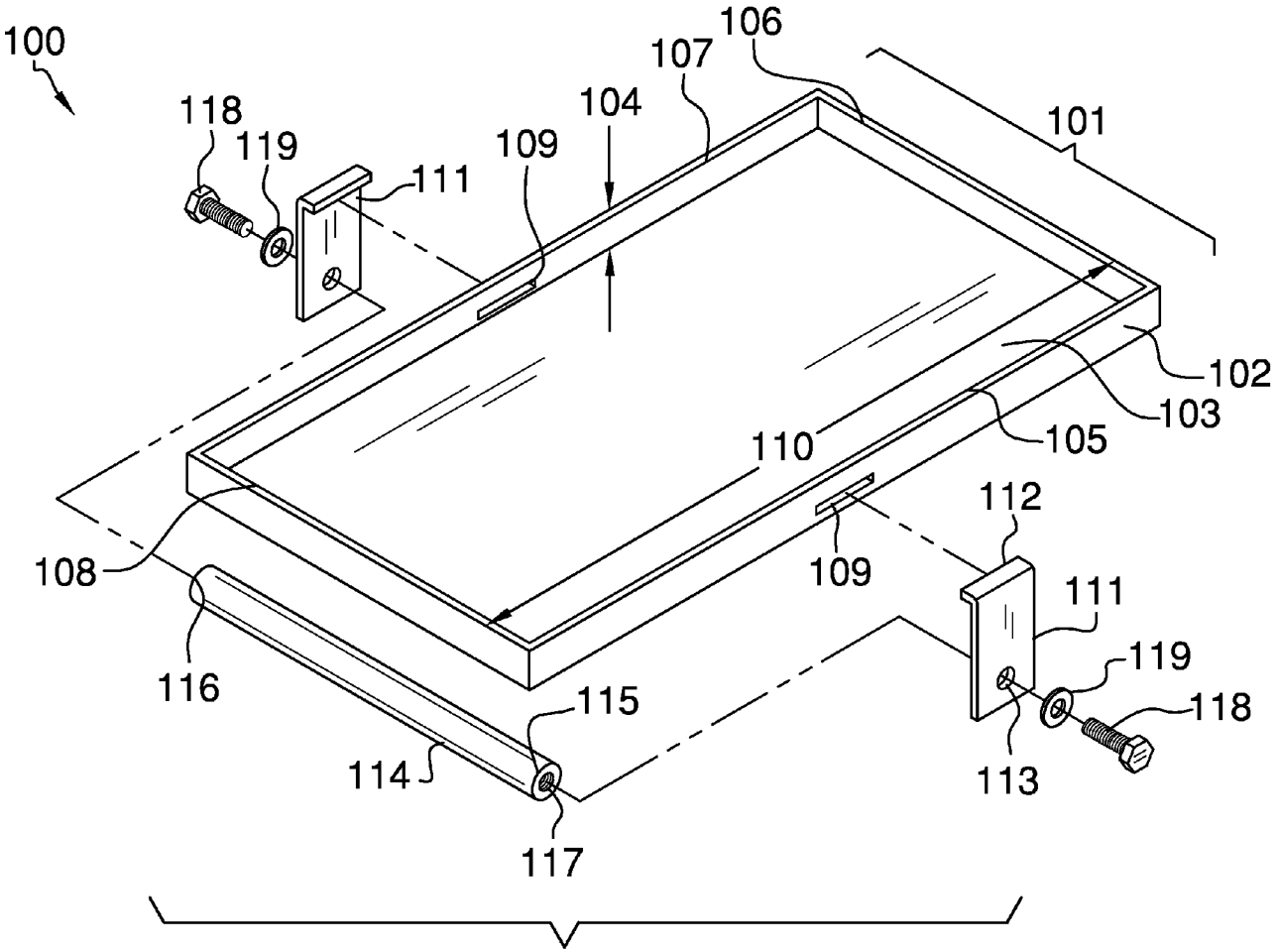
FIG. 1 is a perspective view of an embodiment of the disclosure.
Figure 2:
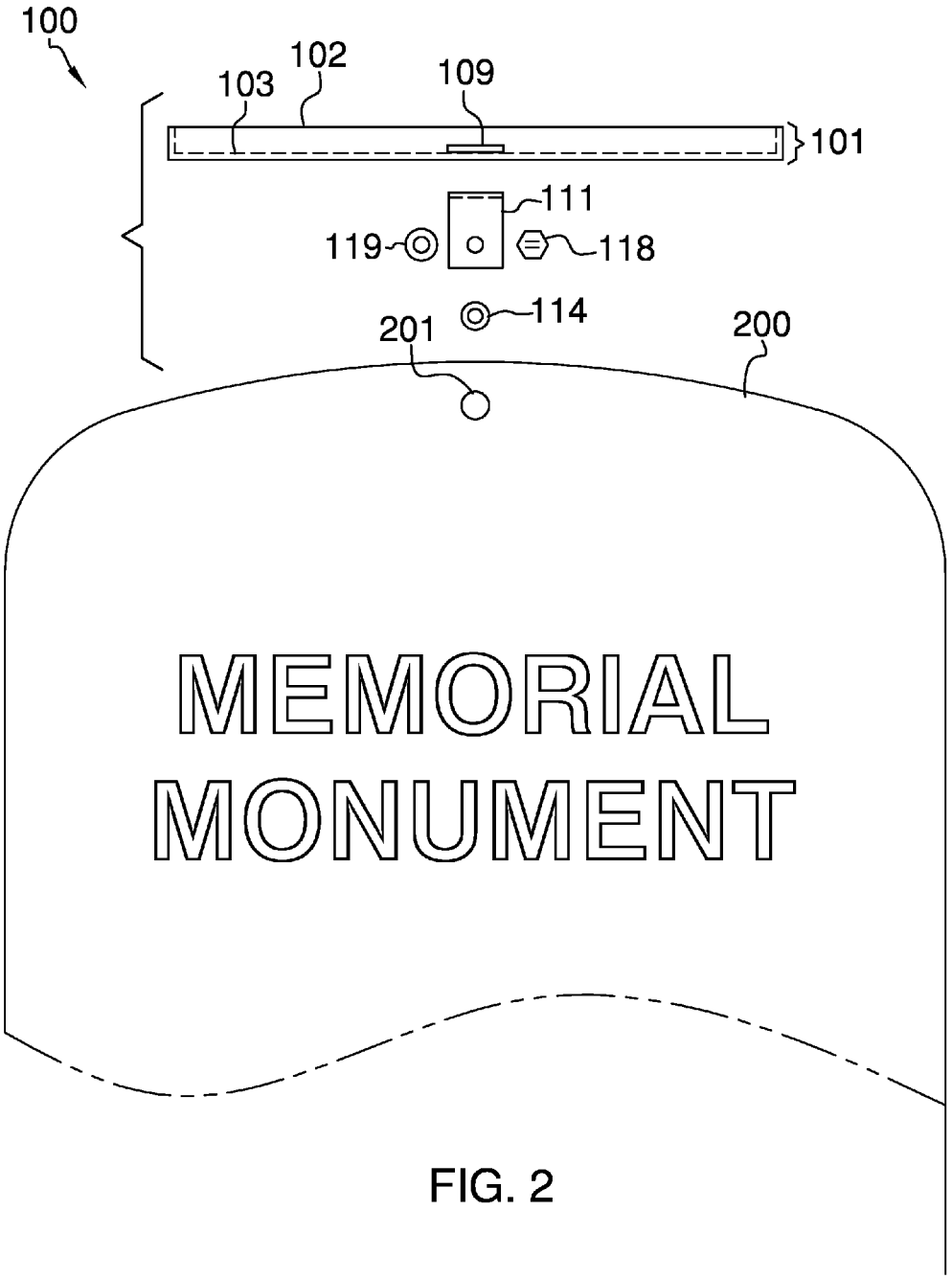
FIG. 2 is an exploded view of an embodiment of the disclosure aligned above a tombstone.
Figure 3:
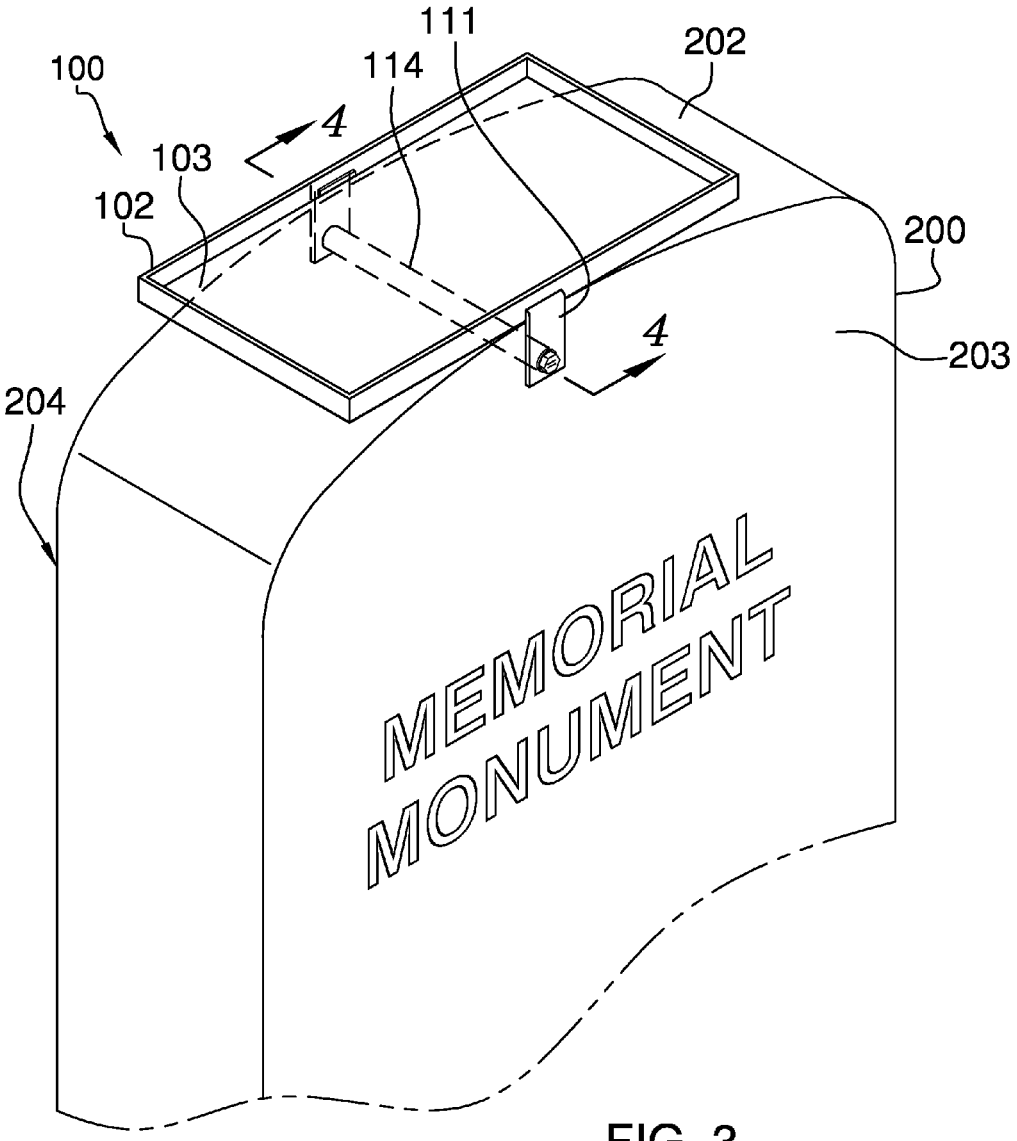
FIG. 3 is a perspective view of an embodiment of the disclosure installed.
Figure 4:
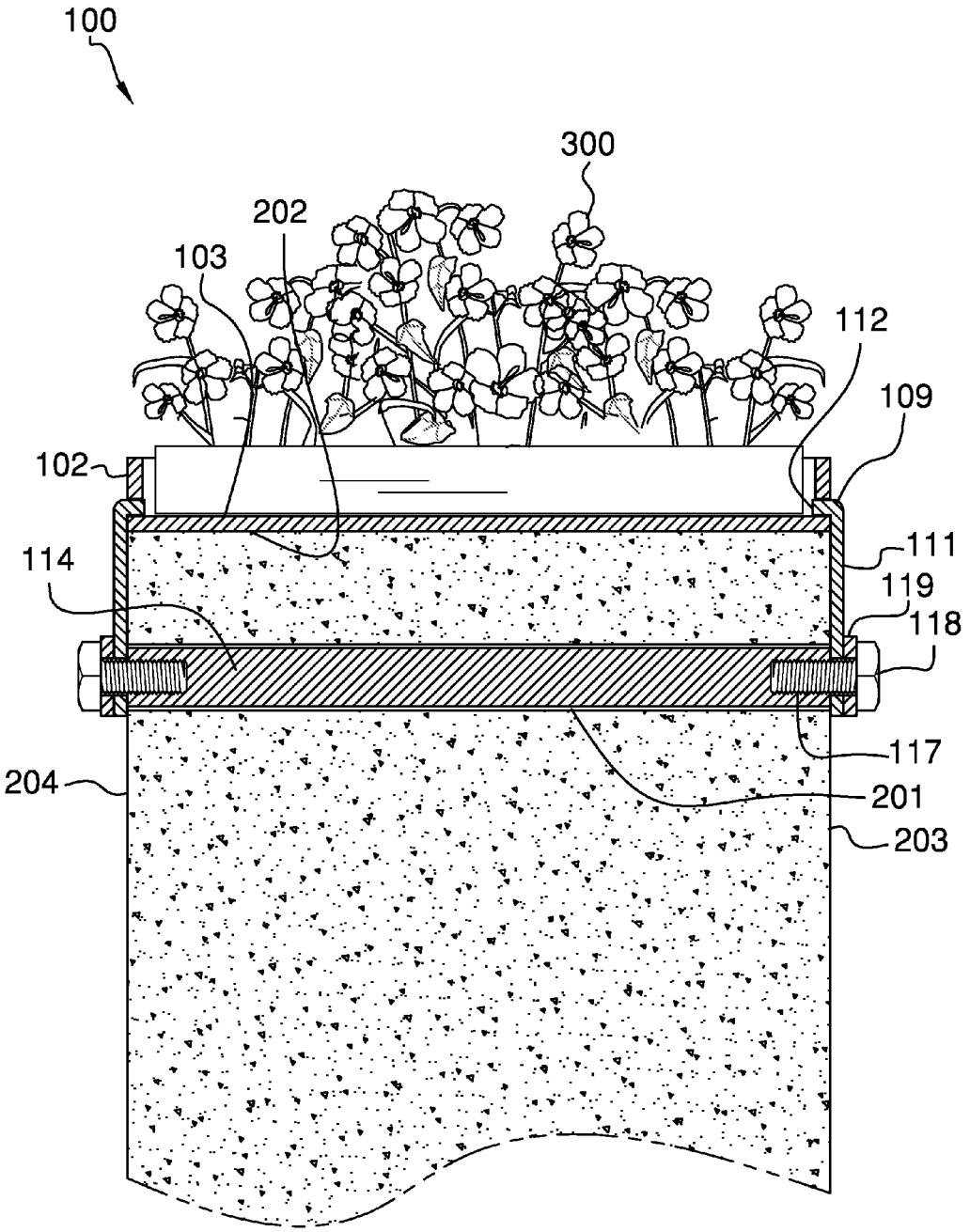
FIG. 4 is a cross-sectional view of an embodiment of the disclosure along line 4-4 in FIG. 3.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

The flower arrangement support 100 (hereinafter invention) comprises a floral saddle 101 that is further defined with a perimeter wall 102 that extends upwardly from a saddle surface 103. The perimeter wall 102 extends a wall height 104 upwardly from the saddle surface 103. The saddle surface 103 may be generally rectangular, but may encompass other shapes. The perimeter wall 102 is further defined with a first wall 105, a second wall 106, a third wall 107, and a fourth wall 108. The first wall 105 is opposite the third wall 107. The second wall 106 is opposite the fourth wall 108. Moreover, the first wall 105 is adjacent the second wall 106 and the fourth wall 108. The third wall 107 is adjacent the second wall 106 and the fourth wall 108.

The first wall 105 and the third wall 107 each include a mounting slot 109 that is centrally located along a saddle length 110. The mounting slot 109 enables one of a pair of mounting clips 111 to attach to the perimeter wall 102, and more importantly, the floral saddle 101. The pair of mounting clips 111 extend downwardly from the perimeter wall 102, and are each further defined with a folded armature 112 that engages the mounting slot 109. The pair of mounting clips 111 each include a clip hole 113, which enables securement of a threaded rod 114 thereto.

The threaded rod 114 is adapted to be inserted into a drill hole 201 of a tombstone 200. The threaded rod 114 includes a first distal end 115 and a second distal end 116. Both the first distal end 115 and the second distal end 116 include a threaded hole 117 thereon. The invention 100 includes a pair of bolts 118 and a pair of washers 119. The pair of bolts 118 and the pair of washers 119 are used to secure the pair of mounting clips 111 to the threaded hole 117 provided on the first distal end 115 and the second distal end 116 of the threaded rod 114.

When installed, the invention 100 is adapted to rest atop of the tombstone 200. Moreover, the saddle surface 103 of the floral saddle 101 is adapted to sit atop of a top tombstone surface 202 of the tombstone 200. The threaded rod 114 and the pair of mounting clips 111 secures the floral saddle to the tombstone 200 in order to prevent the floral saddle 101 from falling off of the tombstone 200. The drill hole 201 extends across a forward tombstone surface 203 to a rear tombstone surface 204.

It shall be noted that the saddle surface 103 is adapted to receive a floral arrangement 300 atop of the tombstone 200. The componentry of the invention 100 may be made of a material comprising metal, plastic, carbon fiber composite, wood, etc.

Figure 5:
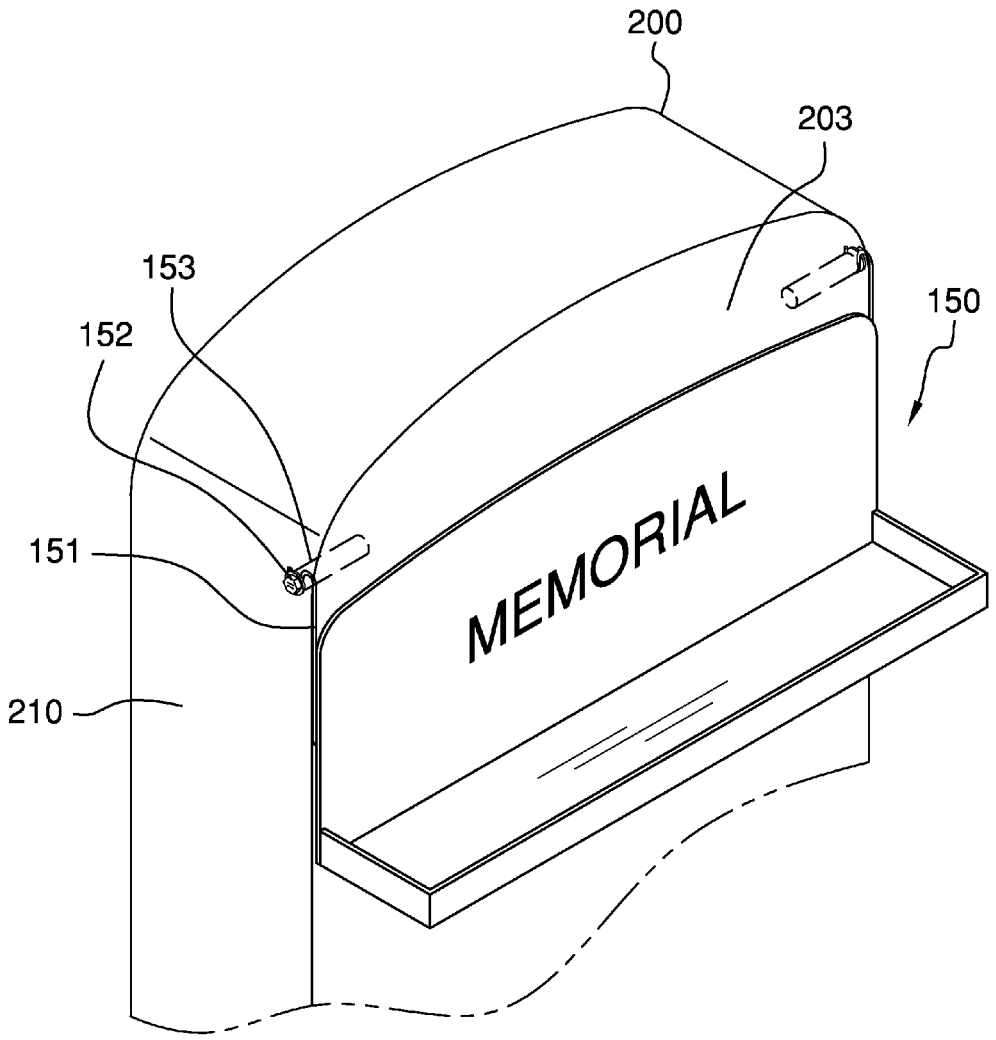
FIG. 5 is a perspective view of an alternative embodiment of the disclosure installed.

Referring to FIG. 5, an alternative embodiment 150 of the invention 100 supports the floral saddle 101 against the forward tombstone surface 203 of the tombstone 200. A pair of brackets 151 extend from the floral saddle 101 to a pair of bolt members 152 that screw into side threaded rods 153 that are drilled into tombstone side surfaces 210.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

Is shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A flower arrangement support comprising:

a floral saddle that is adapted to be seated atop of a tombstone in order to support a floral arrangement or object thereon;

wherein the floral saddle is adapted to be secured to the tombstone via a pair of mounting clips that bolt to a threaded rod that is adapted to be inserted into a drill hole provided in the tombstone;

wherein the floral saddle is further defined with a perimeter wall that extends upwardly from a saddle surface;

wherein the perimeter wall extends a wall height upwardly from the saddle surface;

wherein the saddle surface is generally rectangular;

wherein the perimeter wall is further defined with a first wall, a second wall, a third wall, and a fourth wall;

wherein the first wall is opposite the third wall; wherein the second wall is opposite the fourth wall;

wherein the first wall is adjacent the second wall and the fourth wall; wherein the third wall is adjacent the second wall and the fourth wall;

wherein the first wall and the third wall each include a mounting slot;

wherein the mounting slot of the first wall and of the third wall is centrally located along a saddle length;

wherein the mounting slot enables one of the pair of mounting clips to attach to the perimeter wall;

wherein the pair of mounting clips extend downwardly from the perimeter wall, and are each further defined with a folded armature that engages the mounting slot;

wherein the pair of mounting clips each include a clip hole, which enables securement of the threaded rod thereto;

wherein the threaded rod is adapted to be inserted into the drill hole of the tombstone;

wherein the threaded rod includes a first distal end and a second distal end;

wherein both the first distal end and the second distal end include a threaded hole thereon; and wherein a pair of bolts and a pair of washers secure the pair of mounting clips to the threaded hole provided on the first distal end and the second distal end of the threaded rod.

2. The flower arrangement support according to claim 1 wherein the saddle surface of the floral saddle is adapted to sit atop of a top tombstone surface of the tombstone.

3. The flower arrangement support according to claim 2 wherein the drill hole extends across a forward tombstone surface to a rear tombstone surface.

* * * * *